US008252129B2

(12) United States Patent
Gay et al.

(10) Patent No.: US 8,252,129 B2
(45) Date of Patent: Aug. 28, 2012

(54) METHOD FOR TRANSFORMING STEEL BLANKS

(75) Inventors: Gérald Gay, Saint Etienne (FR); Bruno Gaillard-Allemand, Grazac (FR); Dominique Thierree, Esches (FR)

(73) Assignee: Aubert & Duval, Paris (FR)

( * ) Notice: Subject to any disclaimer, the term of this patent is extended or adjusted under 35 U.S.C. 154(b) by 475 days.

(21) Appl. No.: 12/376,284

(22) PCT Filed: Aug. 2, 2007

(86) PCT No.: PCT/EP2007/058037

§ 371 (c)(1),
(2), (4) Date: Sep. 18, 2009

(87) PCT Pub. No.: WO2008/015260

PCT Pub. Date: Feb. 7, 2008

(65) Prior Publication Data

US 2010/0037992 A1 Feb. 18, 2010

(30) Foreign Application Priority Data

Aug. 3, 2006 (FR) ..... 06 53273

(51) Int. Cl.
*C21D 8/10* (2006.01)

(52) U.S. Cl. ..... 148/593; 148/590; 148/591; 148/909; 148/335; 72/352; 72/370.14; 72/368; 72/367.1

(58) Field of Classification Search ..... 148/570, 148/572, 590, 591, 593, 595, 909, 335; 72/370.01, 72/370.14, 368, 367.1, 352
See application file for complete search history.

(56) References Cited

U.S. PATENT DOCUMENTS

| | | | | |
|---|---|---|---|---|
| 3,132,937 | A | 5/1964 | Sadowski et al. | |
| 3,254,991 | A * | 6/1966 | Shimmin, Jr. et al. | 420/108 |
| 4,359,337 | A | 11/1982 | More | |
| 4,993,690 | A | 2/1991 | Stenzel et al. | |
| 5,207,843 | A | 5/1993 | Maloney et al. | |
| 5,252,120 | A | 10/1993 | Finkl et al. | |
| 5,374,322 | A * | 12/1994 | Okada et al. | 148/663 |
| 5,415,834 | A | 5/1995 | Finkl et al. | |
| 6,652,680 | B2 * | 11/2003 | Grimm et al. | 148/590 |
| 2002/0112786 | A1 | 8/2002 | Abe et al. | |
| 2010/0037992 | A1 | 2/2010 | Gay et al. | |

FOREIGN PATENT DOCUMENTS

| | | | |
|---|---|---|---|
| CN | 1676653 | | 10/2005 |
| DE | 19531260 | A1 | 2/1997 |
| DE | 19531260 | C2 | 5/2000 |
| EP | 0577997 | | 1/1994 |
| EP | 1087030 | | 3/2001 |
| EP | 1239257 | | 9/2002 |
| EP | 1445339 | | 8/2004 |
| JP | 402050912 | * | 2/1990 |
| JP | 8120400 | | 5/1996 |
| LU | 43979 | | 8/1963 |
| SU | 1650715 | | 5/1991 |

OTHER PUBLICATIONS

Brick et al., Martensite Transformation in Iron-Carbon Alloys, Structure and properties of Engineering Materials,46h edition, 1997, p. 131.*

English-hand translation of Japanese patent No. 402050912A, Akira Yagi et al., Feb. 20, 1990.*

Machine translation of DE 19531260 (published Feb. 1997).

Machine translation of JP 06-128661A by Kihara, S. (published May 10, 1994).

Svajger, M. et al., "Thermodynamic and Kinetic Model for Remelting of EDR Ingots Made of Cr-Ni-Mo-V Steels," *11th International Conference on Vacuum Metallurgy*, pp. 125-127 (May 11-14, 1992).

Milan et al., "Thermodynamic and kinetic model for remelting of ESR ingots made of chromium-nickel-molybdenum-vanadium steels," Abstract Only, Supplemental 11th International Conference on Vacuum Metallurgy, 1992, Abstract published 1994.

* cited by examiner

*Primary Examiner* — Deborah Yee
(74) *Attorney, Agent, or Firm* — Klarquist Sparkman, LLP

(57) ABSTRACT

The invention relates to a method for transforming steel blanks. The invention in particular relates to a method for transforming a steel blank comprising kneading in order to obtain very good mechanical properties. The obtained products may notably be used for forming a pressure device component.

15 Claims, No Drawings

METHOD FOR TRANSFORMING STEEL BLANKS

CROSS REFERENCE TO RELATED APPLICATIONS

This is the U.S. National Stage of International Application No. PCT/EP2007/058037, filed Aug. 2, 2007, which was published in English under PCT Article 21(2), which in turn claims the benefit of French Patent Application No. 0653273, filed Aug. 3, 2006. Both applications are incorporated herein in their entirety.

The invention relates to a method for transforming steel blanks, in particular a blank for forming at least one pressure device component.

STATE OF THE ART

Very high performance steels have been developed for many years, for manufacturing components of pressure devices which may withstand 4,000 to 10,000 bars, notably including breech plugs or sleeves or tubes for forming components of a pressure device. These steels should meet qualities of compositions which are very strictly defined and with them very good mechanical properties should be obtained, and notably a very high yield point and a good yield point/toughness ratio, notably at low temperature.

Obtaining very low silicon and manganese contents but relatively high chromium, molybdenum and nickel contents is notably required.

Different compositions have been proposed in the prior art for obtaining steels meeting these mechanical properties, however the mechanical characteristics of these steels should be further improved. Such steels are notably described in DE 195 31 260 C2. Thus, the steels should be improved as for their composition and mechanical properties, and notably as for the yield point and the yield point/toughness ratio, in particular at low temperature.

With the usual transformation methods for this type of steel, it is not possible to obtain optimum mechanical properties when it is desired to used this steel as a tube with a very high yield point and/or a good low temperature yield point/toughness ratio, notably in the field of pressure devices which in particular withstand 4,000 to 10,000 bars.

On the other hand, methods customarily known have a duration which is not compatible with significant industrial activity. This is notably the case of a method described in DE 19531260, the method of which comprises an austenitization step followed by a pearlitic annealing step for 100-200 hours.

OBJECTS OF THE INVENTION

The main object of the invention is to solve the technical problems stated above and notably to provide a steel composition with which mechanical properties may be obtained, notably in terms of yield point and of compromise between the optimized yield point/toughness notably at low temperature, suitable for forming a pressure device component.

The main object of the invention is to solve the technical problems mentioned above and notably the technical problem consisting of providing a transformation method with which a steel tube of the aforementioned composition may be obtained, having very good mechanical properties, notably including a very high yield point combined with a high level of ductility.

The object of the invention is notably to solve this technical problem within the scope of manufacturing components for pressure devices, notably by an industrially performing method in terms of cost-effectiveness and manufacturing time.

DESCRIPTION OF THE INVENTION

In particular, the present invention relates to a steel composition essentially comprising:

Carbon: 0.35-0.43,
Manganese: <0.20,
Silicon: <0.20,
Nickel: 3.00-400
Chromium: 1.30-1.80,
Molybdenum: 0.70-1.00
Vanadium: 0.20-0.35,
Iron: balance in weight percentages of the total composition, as well as the inevitable impurities, kept at a lower level, notably as copper (preferably <0.100); aluminium (preferably <0.015); sulphur (preferably <0.002); phosphorus (preferably <0.010); tin (preferably <0.008); arsenic (preferably <0.010); antimony (preferably <0.0015); in general essentially introduced by the raw materials; and calcium (preferably <0.004), dioxygen (preferably <0.004); dihydrogen (preferably <0.0002); and dinitrogen (preferably <0.007) generally due essentially to the manufacturing process. With this steel, it is possible to meet the requirements of the mechanical properties required for forming a component of a pressure device withstanding 4,000 to 10,000 bars, such as notably a breech plug or sleeve or a tube of a pressure device, such as a cannon tube.

Surprisingly, it was discovered that it was possible to solve the aforementioned technical problems and notably obtain a very high yield point and a good low temperature yield point/toughness ratio for an aforementioned steel composition, the kneading rate is less than or equal to 5 and preferably of about 4.5, on the largest cross-section of the steel component, notably in tubular or cylindrical form.

Thus, the present invention describes a method for transforming a steel blank with a substantially tubular or cylindrical shape essentially comprising the following composition:

Carbon: 0.35-0.43,
Manganese: <0.20,
Silicon: <0.20,
Nickel: 3.00-4.00,
Chromium: 1.30-1.80,
Molybdenum: 0.70-1.00
Vanadium: 0.20-0.35,
Iron: balance in weight percentages of the total composition, as well as the inevitable impurities including dinitrogen (preferably $N_2$<70 ppm), dioxygen (preferably $O_2$<30 ppm) and dihydrogen (preferably $H_2$<2 ppm), said method comprising a step for transforming the blank by kneading in order to obtain a kneading rate of the thickest cross-section of the substantially tubular or cylindrical form, less than or equal to 5, and preferably less than or equal to 4.5.

It is of interest to carry out a transformation of the aforementioned steel by forging comprising a rise in temperature and for a sufficient time in order to reduce segregations within the steel. Maintaining the temperature of the ingot before forging provides chemical homogenization and may participate in improving the mechanical characteristics.

It is possible to perform at least one heating operation in order to draw the tube at a temperature at which cracks may be avoided, and a kneading rate less than or equal to 5 and preferably less than or equal to 4.5 may be obtained.

By a substantially cylindrical blank is meant for example a blank with the shape of a polygonal or smooth cylinder. A tube may advantageously be obtained by drilling after kneading.

Thus, tubes having an inner diameter of at least 80 mm may be manufactured. For example, tubes of 105 mm, 120 mm, 140 mm, and 155 mm may be manufactured with very good mechanical properties for cannon tubes. The thicknesses are generally larger than 100 mm, and this up to outer diameters of 400 mm.

Advantageously, after the kneading, the method comprises annealing in order to improve the structure of the steel.

Preferably, the annealing operation comprises a normalization step in order to improve the structure of the steel, notably by maintaining it at a temperature of at least 900° C., for example for at least 1 h for a thickness of 50 mm of the tube and cooling with air down to about 400° C.

Controlling the cooling rates after forging and/or normalization advantageously participates in improving the mechanical characteristics of the material.

Preferably, the annealing comprises an anti-flaking annealing step comprising maintaining a temperature of about 650° C., when the dihydrogen content requires such a treatment.

Advantageously, the method comprises at least oven-cooling in order to avoid risks of cracks upon cooling, notably during the normalization or the anti-flaking annealing.

Preferably, heat treatment is carried out on the obtained steel cylinder or tube at the end of kneading in order to obtain a steel cylinder or tube having essentially entirely a martensitic structure, and preferably an entirely martensitic structure. The heat treatment advantageously comprises quenching in a fluid with suitable cooling power (for example: oil) in order to lead to an essentially entirely martensitic structure and for reducing the risk of cracking. The heat treatment advantageously comprises tempering in order to substantially lead to maximum hardness of the steel. The heat treatment advantageously comprises at least one tempering operation in order to substantially obtain the homogeneity of the mechanical characteristics along the steel cylinder or tube.

Very good mechanical characteristics (high yield point, good toughness at low temperature) are guaranteed even when using oil quenching, which is quite advantageous because the risk of cracking may thereby be limited during the quenching operation.

According to a particular embodiment, the steel blank with a substantially tubular or cylindrical shape is obtained by a method for elaborating the steel blank comprising electroconductive slag remelting (ESR) or vacuum arc remelting (VAR), in order to optimize the composition, notably by reducing the impurities, but also by obtaining a blank leading to excellent mechanical properties after transformation.

The present invention relates to a steel blank in order to form a pressure device component which may be obtained in any of the steps of the method described above.

Other objects, features and advantages of the invention will become clearly apparent to one skilled in the art after reading the explanatory description which refers to examples which are only given as an illustration and which could by no means limit the scope of the invention.

The examples are an integral part of the present invention and any feature which appears to be novel relatively to any prior state of the art, from the description taken as a whole, including the examples, is an integral part of the invention in its function and in its generality.

Thus, each example has a general scope.

On the other hand, in the examples, all the percentages are given by weight, unless specified otherwise, and the temperature is expressed in degrees Celsius unless specified otherwise, and the pressure is atmospheric pressure, unless specified otherwise.

EXAMPLES

Example 1

Transformation: Forging

One (or more) steel blank with a substantially tubular or cylindrical shape essentially comprising the following composition:

Carbon: 0.37-0.42
Manganese: <0.15,
Silicon: <0.100
Nickel: 3.50-3.80
Chromium: 1.50-1.70,
Molybdenum: 0.70-1.00
Vanadium: 0.25-0.30, in weight percentages of the total composition, as well as the inevitable impurities including dioxygen (preferably <0.004); dihydrogen (preferably <0.0002); and dinitrogen (preferably <0.007), is transformed in order to provide a tube which may be used in armament, such as a cannon tube having a very high yield point and a good yield point/toughness ratio at low temperature.

The gas contents of the steel ($O_2$, $N_2$, $H_2$) are dosed during elaboration and upon casting the ingots, by means of gas analyzers. Oxygen activities and hydrogen partial pressures are measured during elaboration by electrochemical devices: $0_2$ cell, Hydriss probe.

This blank underwent the following transformation steps:

1 Ingot heating before forging:

The ingot is heated in order to reduce segregations on the product (for example, for at least 10 hrs, up to about 1200° C. for an ingot of 8-10 tons);

2 Forging the obtained ingot (for example, in order to make a tube having an inner diameter of 120 mm) comprising at least one heating operation in order to avoid cracks and obtain a kneading rate less than 5 and preferably less than 4.5 on the cross-section, notably the largest cross-section.

Forging may notably comprise the following steps:

After first heating, refiring is carried out at a temperature for example of about 1200-1230° C., for e.g. at least four hours.

Performing a second hot drawing.

With this method, a cylindrical or tubular blank may be obtained for example according to the outer dimensions:

Breech: Ø 350×1500 mm
Ø 300×800 mm
Ø 250×2500 mm
barrel: Ø 235×1600 minimum, total length >6300 mm Kneading rates of 4.5 or less are thereby obtained in the breech, which is quite surprising since the kneading rate normally obtained in the breech for this type of steel grade is larger than 5.

If the blank is not of a tubular shape, drilling is then performed in order to obtain the desired tube.

Preferably, annealing is carried out after forging in order to obtain an essentially entirely martensitic structure and thus a better yield point in applications as a pressure device component, such as a cannon tube.

Example 2

Transformation: Annealing after Forging

Annealing is carried out after forging, for example on the tube obtained in Example 1, in order to improve the microstructure of the steel (normalization step) to avoid risks of cracks upon cooling (oven-cooling steps) and to avoid <<flake>> or <<DDH>> type occurrences on products after cooling, with anti-flaking annealing when the blanks have been remelted by the ESR process in solid or liquid slag or by the vacuum remelting (VAR) method.

Example 3

Transformation: Quality Heat Treatment

For example, the tube or cylinder obtained according to Example 2 is advantageously trued up for the heat treatment profile comprising a quality heat treatment. This treatment has the purpose of imparting to the tubes or cylinders all the required mechanical properties while optimizing the compromise of yield point/resilience at −40° C. and K1c or J1c at −40° C.

Oil quenching or quenching with another suitable cooling fluid notably leads to a entirely martensitic structure while avoiding the risk of cracking. This quality heat treatment advantageously comprises first tempering leading to maximum hardness; two tempering operations are carried out at temperatures which may guarantee large homogeneity of the mechanical characteristics along the tube while improving the resilience level. By carrying out three tempering operations and slow cooling in the oven after the last tempering operation, it is possible to guarantee the final straightness of the tube and the absence of deformations during the final machining.

As an example, the quality heat treatment comprises:

AUSTENITIZATION+QUENCHING:

Introduction of the tube into the oven at a temperature less than about 450° C.;

A rise in temperature, for example up to a temperature above 850° C. at a rate of less than about 80° C./h;

Maintaining the temperature above 850° C. for a period longer than 4 hrs for a tube blank of 120 mm;

Oil quenching with for example an injection of oil into the bore until a temperature less than, for example about 150° C. at any point, is obtained, and followed by air cooling down to about 80° C. for example.

FIRST TEMPERING at a temperature above 500° C.;

SECOND TEMPERING at a temperature above 550° C.;

THIRD TEMPERING at a temperature above 500° C.

The tempering operations may be carried out vertically with setting of the products into rotation in order to guarantee proper straightness.

During the process, hot straightening operations may be performed in order to guarantee general proper straightness of the tubes or cylinders. Thus, the following mechanical properties may be obtained:

1,350 MPa<Rm<1,600 Mpa;

1,250<Rp0.2%<1,450 Mpa

A %>12%;

Z %>35%;

Excellent resilience and toughness at low temperature are obtained

KV (−40° C.)>28 J

K1c (ou KQ)(−40° C.)>110 Mpa·$m^{1/2}$

These strength and toughness values are obtained for yield points (Rp0.2%) up to 1,450 Mpa. This is notably obtained by selection and by the element contents of the steel (C, Ni, Cr, Mo, V), and by thermomechanical treatment (forging, heat treatments).

Examples of obtained mechanical properties:

TABLE 1 by elaboration with an electric arc oven (FEA) + vacuum arc degassing (VAD):

| | Number of | Breech side | | | Mouth side | | | K1C Kq (Mpa · m1/2) |
|---|---|---|---|---|---|---|---|---|
| Cast | the tube | YS (Mpa) | UTS (Mpa) | KV-40 (J) | YS (Mpa) | UTS (Mpa) | KV-40 (J) | Moy. > 110 |
| A | 1 | 1334 | 1452 | 35.2 | 1349 | 1464 | 41.1 | 155.9 |
| | 2 | 1372 | 1480 | 29.5 | 1396 | 1493 | 34.8 | 139.2 |
| B | 1 | 1366 | 1481 | 30.5 | 1400 | 1498 | 35.2 | 113.7 |
| | 2 | 1367 | 1484 | 29.8 | 1390 | 1493 | 33.6 | 139.5 |
| | 3 | 1374 | 1480 | 29.2 | 1391 | 1481 | 35.4 | 137.4 |
| | 4 | 1336 | 1462 | 29.5 | 1331 | 1460 | 36.9 | 123.7 |
| C | 1 | 1335 | 1457 | 33.6 | 1341 | 1469 | 37.6 | 120.1 |
| | 2 | 1284 | 1427 | 46.7 | 1319 | 1453 | 49.8 | — |
| | 3 | 1382 | 1486 | 29.5 | 1343 | 1452 | 33.7 | 149.2 |
| D | 1 | 1357 | 1475 | 29.7 | 1371 | 1482 | 31 | 135.5 |
| | 2 | 1353 | 1482 | 31.1 | 1373 | 1507 | 29.9 | 146.8 |
| E | 1 | 1373 | 1499 | 28.7 | 1409 | 1533 | 28 | 145.8 |
| | 2 | 1380 | 1489 | 24.2 | 1359 | 1478 | 33.2 | — |
| | 3 | 1378 | 1495 | 20.7 | 1351 | 1477 | 31.6 | — |
| | 4 | 1360 | 1450 | 29.7 | 1367 | 1464 | 28.8 | 166.7 |
| F | 1 | 1335 | 1451 | 29 | 1365 | 1468 | 29.5 | 154.3 |
| | 2 | 1359 | 1460 | 37.2 | 1368 | 1480 | 34.9 | 149.4 |
| | 3 | 1360 | 1464 | 30.3 | 1356 | 1468 | 29.3 | 163.6 |
| | 4 | 1346 | 1451 | 33.5 | 1371 | 1457 | 33 | 159.1 |
| | 5 | 1337 | 1453 | 38.5 | 1364 | 1473 | 36.4 | 146.1 |
| G | 1 | 1341 | 1454 | 35.9 | 1364 | 1472 | 38 | 134.9 |
| | 2 | 1343 | 1455 | 30.9 | 1359 | 1462 | 31.3 | 162.3 |
| | 3 | 1333 | 1447 | 29.1 | 1365 | 1468 | 35.8 | 110.9 |
| H | 1 | 1333 | 1452 | 29.4 | 1347 | 1464 | 36.2 | 134.5 |

TABLE 1-continued

| by elaboration with an electric arc oven (FEA) + vacuum arc degassing (VAD): | | | | | | | | |
|---|---|---|---|---|---|---|---|---|
| | Number of | Breech side | | | Mouth side | | | K1C Kq (Mpa · m1/2) |
| Cast | the tube | YS (Mpa) | UTS (Mpa) | KV-40 (J) | YS (Mpa) | UTS (Mpa) | KV-40 (J) | Moy. > 110 |
| Average | | 1352 | 1462 | 31.3 | 1365 | 1476 | 34.4 | 142.3 |
| Min. | | 1284 | 1427 | 20.7 | 1319 | 1452 | 28 | 110.9 |
| Max. | | 1382 | 1499 | 46.7 | 1409 | 1533 | 49.8 | 166.7 |

TABLE 2

| by ElectreoSlag remelting (ESR) | | | | | | | | |
|---|---|---|---|---|---|---|---|---|
| | Number of | Breech side | | | | Mouth side | | |
| Cast | tube | YS (MPa) | UTS (MPa) | KV-40 (J) | K1C Kq (Mpa · m1/2) | YS (MPa) | UTS (MPa) | KV-40 (J) |
| A | 1 | 1380 | 1520 | 34.4 | 162 | 1409 | 1550 | 33.1 |
| | 2 | 1384 | 1501 | 35.3 | 153 | 1399 | 1541 | 34.4 |
| | 3 | 1385 | 1522 | 33.6 | 133 | 1405 | 1545 | 37.7 |
| | 4 | 1388 | 1532 | 32.0 | 151 | 1411 | 1551 | 35.8 |
| | 5 | 1392 | 1527 | 37.1 | 147 | 1406 | 1548 | 37.3 |
| | 6 | 1386 | 1521 | 36.0 | 157 | 1404 | 1540 | 35.4 |
| | 7 | 1337 | 1480 | 41.2 | 164 | 1357 | 1499 | 42.5 |
| | 8 | 1342 | 1470 | 38.1 | 161 | 1366 | 1499 | 39.8 |
| | 9 | 1327 | 1458 | 35.4 | 144 | 1372 | 1508 | 41.8 |
| | 10 | 1352 | 1474 | 38.4 | 146 | 1377 | 1515 | 41.2 |
| | 11 | 1329 | 1464 | 38.7 | 141 | 1378 | 1518 | 40.3 |
| | 12 | 1332 | 1465 | 37.7 | 155 | 1382 | 1518 | 38.3 |
| | 13 | 1334 | 1487 | 42.0 | 150 | 1366 | 1522 | 43.1 |
| | 14 | 1345 | 1481 | 37.3 | 145 | 1377 | 1515 | 35.9 |
| | 15 | 1337 | 1488 | 34.9 | 142 | 1364 | 1519 | 40.8 |
| | 16 | 1331 | 1475 | 37.5 | 135 | 1349 | 1509 | 40.6 |
| | 17 | 1340 | 1469 | 35.3 | 157 | 1390 | 1529 | 34.4 |
| | 18 | 1349 | 1494 | 31.6 | 149 | 1346 | 1491 | 36.1 |
| | 19 | 1348 | 1503 | 31.5 | 144 | 1359 | 1512 | 38.1 |
| B | 1 | 1359 | 1511 | 31.5 | 115 | 1366 | 1517 | 37.5 |
| | 2 | 1364 | 1513 | 34.2 | 144 | 1353 | 1510 | 35.3 |
| | 3 | 1374 | 1521 | 32.2 | 129 | 1378 | 1527 | 37.4 |
| C | 1 | 1366 | 1492 | 35.3 | 155 | 1395 | 1530 | 36.7 |
| | 2 | 1369 | 1497 | 35.5 | 163 | 1398 | 1521 | 40.5 |
| | 3 | 1406 | 1511 | 37.5 | 151 | 1391 | 1529 | 37.5 |
| | 4 | 1378 | 1503 | 37.3 | 155 | 1400 | 1541 | 34.6 |
| | 5 | 1379 | 1508 | 37.7 | 164 | 1395 | 1542 | 35.5 |
| | 6 | 1383 | 1504 | 32.4 | 153 | 1383 | 1538 | 36.3 |
| | 7 | 1363 | 1498 | 33.2 | 144 | 1374 | 1522 | 33.7 |
| D | 1 | 1362 | 1483 | 33.9 | 125 | 1335 | 1485 | 43.6 |
| E | 1 | 1339 | 1444 | 38.3 | 132 | 1376 | 1505 | 37.6 |
| | 2 | 1330 | 1450 | 42.1 | 138 | 1369 | 1502 | 44.6 |
| | 3 | 1354 | 1456 | 37.6 | 119 | 1371 | 1517 | 34.7 |
| Average | | 1359 | 1492 | 36.0 | 146.0 | 1379 | 1522 | 37.9 |
| Minimum. | | 1327 | 1444 | 31.5 | 115 | 1335 | 1485 | 33.1 |
| Maximum. | | 1406 | 1532 | 42.1 | 164 | 1411 | 1551 | 44.6 |

TABLE 3

| by Vaccum Arc Remelting (VAR) | | | | | | | |
|---|---|---|---|---|---|---|---|
| | Number | Breech side | | | Mouth side | | |
| Cast | of tube | YS (MPa) | UTS (MPa) | KV-40 (J) | YS (MPa) | UTS (MPa) | KV-40 (J) |
| A | 1 | 1362 | 1478 | 32.5 | 1274 | 1423 | 42 |
| | 2 | 1366 | 1477 | 38.0 | 1280 | 1420 | 43 |
| | 3 | 1325 | 1440 | 27.7 | 1293 | 1423 | 34.5 |
| | 4 | 1340 | 1458 | 35.2 | 1275 | 1440 | 39.5 |
| Average | | 1348.3 | 1463.3 | 33.4 | 1280.5 | 1426.5 | 39.8 |
| Min. | | 1325 | 1440 | 27.7 | 1274 | 1420 | 34.5 |
| Ma.i | | 1366 | 1477 | 38 | 1293 | 1440 | 43 |
| B | 1 | 1309 | 1430 | 40 | 1255 | 1388 | 36 |
| | 2 | 1328 | 1442 | 36 | 1266 | 1404 | 38 |
| | 3 | 1286 | 1390 | 45 | 1263 | 1380 | 48 |
| | 4 | 1290 | 1399 | 49 | 1258 | 1379 | 54 |

TABLE 3-continued

| by Vaccum Arc Remelting (VAR) | | | | | | | |
|---|---|---|---|---|---|---|---|
| | Number | Breech side | | | Mouth side | | |
| Cast | of tube | YS (MPa) | UTS (MPa) | KV-40 (J) | YS (MPa) | UTS (MPa) | KV-40 (J) |
| Average | | 1303.3 | 1415.2 | 42.4 | 1260.3 | 1388.0 | 44.0 |
| Min. | | 1286 | 1390 | 36 | 1255 | 1379 | 36 |
| Max. | | 1328 | 1442 | 49 | 1266 | 1404 | 54 |

The invention claimed is:

1. A method for transforming a steel blank with a tubular or substantially cylindrical shape essentially comprising the following composition in weight percentages of the total composition:

Carbon: 0.37-0.42,
Manganese: <0.15,
Silicon: <0.100,
Nickel: 3.50-3.80,
Chromium: 1.50-1.70,
Molybdenum: 0.70-1.00
Vanadium: 0.25-0.30,
Iron: balance
as well as inevitable impurities which are generally dinitrogen, dioxygen and dihydrogen,
said method comprising a step for transforming the blank by kneading in order to obtain a kneading rate of the thickest cross-section of the tubular or substantially cylindrical form, less than or equal to 5.

2. The method according to claim 1, wherein the method comprises after kneading, annealing for improving the structure of the steel.

3. The method according to claim 2, wherein the annealing comprises an anti-flaking annealing step comprising maintaining the temperature of about 650° C.

4. The method according to claim 1 or 2, wherein it comprises at least oven-cooling after hot kneading and/or annealing in order to avoid risks of cracks upon cooling.

5. The method according to claim 1, wherein a steel cylinder or tube is obtained and wherein a heat treatment is carried out on said steel cylinder or tube in order to obtain a steel cylinder or tube having an entirely martensitic structure.

6. The method according to claim 5, wherein the heat treatment comprises heating then oil quenching or quenching with a fluid with suitable cooling power in order to lead to an entirely martensitic structure and to reduce the risk of cracking.

7. The method according to claim 5 or 6, wherein after heat treatment a first tempering operation is carried out in order to increase hardness of the steel.

8. The method according to claim 5, wherein after heat treatment at least one tempering operation is carried out in order to obtain homogeneity of in mechanical characteristics along the steel cylinder or tube.

9. The method according to claim 1, wherein the steel blank with a tubular or substantially cylindrical shape is obtained by a method for elaborating the steel blank comprising an electroconductive slag remelting (ESR) or vacuum arc remelting (VAR).

10. The method according to claim 1, wherein after kneading the method comprises a normalizing step followed by controlled cooling rates to improve the mechanical characteristics of the steel.

11. The method according to claim 1, wherein the kneading consists in forging and wherein before forging, heating the ingot and maintaining the temperature are carried out in order to homogenize the chemical composition and to participate in improving the mechanical characteristics.

12. A steel blank for forming a pressure device component capable of being obtained by a method as defined according to any of claims 1, 2, 3, 5, 6 and 8 to 11.

13. The method according to claim 1, wherein the transformation step by kneading consists in forging which comprises a rise in temperature and for a sufficient time in order to reduce segregation within the steel.

14. The method according to claim 13, wherein after forging the method comprises a controlled cooling rate to improve the mechanical characteristics of the steel.

15. The method according to claim 13, wherein it comprises at least oven-cooling after forging in order to avoid risks of cracks upon cooling.

* * * * *